US007762789B2

(12) United States Patent
Scarpinato

(10) Patent No.: US 7,762,789 B2
(45) Date of Patent: Jul. 27, 2010

(54) COMPRESSOR WITH FLOW CONTROL SENSOR

(75) Inventor: Paul A. Scarpinato, Clemmons, NC (US)

(73) Assignee: Ingersoll-Rand Company, Montvale, NJ (US)

( * ) Notice: Subject to any disclaimer, the term of this patent is extended or adjusted under 35 U.S.C. 154(b) by 374 days.

(21) Appl. No.: 11/938,626

(22) Filed: Nov. 12, 2007

(65) Prior Publication Data

US 2009/0120114 A1 May 14, 2009

(51) Int. Cl.
*F04B 39/04* (2006.01)

(52) U.S. Cl. ..... 417/228; 417/313

(58) Field of Classification Search ..... 62/201, 62/185, 505; 236/34.5, 93, 12.1, 12.13, 12.11, 236/93 R; 165/297, 300; 417/228, 313; 415/118, 175, 151; 251/11
See application file for complete search history.

(56) References Cited

U.S. PATENT DOCUMENTS 2,470,655 A * 5/1949 Shaw ..... 418/1
3,355,905 A 12/1967 Berhold et al.
3,428,242 A 2/1969 Rannenberg
3,759,348 A * 9/1973 Kasahara ..... 184/6.23
3,785,755 A * 1/1974 Novak et al. ..... 418/85
3,795,117 A 3/1974 Moody, Jr. et al.
3,820,350 A * 6/1974 Brandin et al. ..... 62/193
3,851,494 A 12/1974 Hess
4,289,461 A * 9/1981 van Oorschot et al. ..... 418/84
4,358,247 A * 11/1982 Suzuki et al. ..... 417/13
4,605,357 A * 8/1986 Keith ..... 417/228
4,742,689 A 5/1988 Lowes
4,767,259 A 8/1988 Kurosawa et al.
4,967,552 A 11/1990 Kumata et al.
4,974,427 A 12/1990 Diab
5,082,427 A 1/1992 Fujiwara et al.
5,139,393 A 8/1992 Sulmone
5,171,130 A * 12/1992 Kume et al. ..... 417/228
5,758,485 A 6/1998 Frutschi
6,530,347 B2 * 3/2003 Takahashi et al. ..... 123/41.1
6,560,966 B1 5/2003 Fetescu et al.
6,575,707 B2 6/2003 Matt et al.
6,644,035 B1 11/2003 Yamanaka et al.
6,672,081 B1 1/2004 Albaroudi et al.
6,722,858 B2 * 4/2004 Yoshimura et al. ..... 417/313
7,094,037 B2 * 8/2006 Nakamura et al. ..... 417/63
7,114,913 B2 * 10/2006 Coker ..... 415/47
7,182,048 B2 * 2/2007 Nakano ..... 123/41.1
2002/0050251 A1 * 5/2002 Takahashi et al. ..... 123/41.1
2003/0223885 A1 * 12/2003 Nakamura et al. ..... 417/228
2003/0228229 A1 * 12/2003 Yoshimura et al. ..... 417/199.1

(Continued)

*Primary Examiner*—George Nguyen
(74) *Attorney, Agent, or Firm*—Michael Best & Friedrich LLP

(57) ABSTRACT

A compressor discharges a flow of compressed fluid at a predetermined temperature. The compressor includes a sensor positioned to measure a first temperature indicative of the temperature of the compressed fluid, a coolant source, a cooler positioned to receive a first flow of coolant from the coolant source and discharge a flow of cooled coolant, and a valve positioned to receive the flow of cooled coolant and a second flow of coolant from the coolant source. The valve is configured to discharge a coolant flow to the compressor and the coolant flow has a ratio of cooled coolant to second flow of coolant that is variable in response to the first temperature.

20 Claims, 2 Drawing Sheets

U.S. PATENT DOCUMENTS

2004/0065275 A1* 4/2004 Hayami et al. ..... 123/41.1
2004/0172947 A1 9/2004 Takahama
2006/0067833 A1 3/2006 McAuliffe et al.
2006/0213461 A1* 9/2006 Hayami ..... 123/41.15
2007/0178347 A1* 8/2007 Siepierski et al. ..... 429/24

* cited by examiner

COMPRESSOR WITH FLOW CONTROL SENSOR

BACKGROUND

The present invention relates to compressors. More specifically, to temperature control of a compressor, such as a variable-speed compressor.

Compressors often employ a coolant such as oil to cool the compressor during operation. The oil also serves as a lubricant between moving parts and enhances the seal between moving parts to improve compression efficiency. During operation, the coolant is heated by friction as well as contact with the compressed fluid and the moving components. Compressor systems typically include a cooler that receives and cools the coolant to maintain the temperature in a desired temperature range. To maintain the temperature, a portion of un-cooled coolant is often mixed with cooled coolant to maintain a coolant inlet temperature. However, in systems that employ a variable speed compressor, the compressor outlet temperature can vary greatly. This variability can result in unstable or inefficient operation of the compressor system.

SUMMARY

In one embodiment, the invention provides a compressor that discharges a flow of compressed fluid at a predetermined temperature. The compressor includes a sensor positioned to measure a first temperature indicative of the temperature of the compressed fluid and a coolant source. A cooler is positioned to receive a first flow of coolant from the coolant source and discharge a flow of cooled coolant. A valve is positioned to receive the flow of cooled coolant and a second flow of coolant from the coolant source. The valve is configured to discharge a coolant flow to the compressor and the coolant flow has a ratio of cooled coolant to second flow of coolant that is variable in response to the first temperature.

In another embodiment the invention provides a compressor system that includes a compressor that is configured to receive a flow of coolant and a flow of fluid and to discharge a flow of compressed fluid at a temperature. A source is positioned to receive the flow of compressed fluid and to separate the flow of compressed fluid into a coolant and a compressed gas. A cooler is positioned to receive a first flow of coolant from the source and discharge a cooled coolant. A bypass passage is positioned to receive a second flow of coolant from the source. A sensor is configured to measure a discharge temperature of the flow of compressed fluid. A control valve is moveable in response to the measured discharge temperature to vary a flow rate of the cooled coolant and a flow rate of the second flow of coolant from the source and to direct a flow of coolant to the compressor.

In another embodiment the invention provides a method of compressing a fluid. The method includes directing a flow of coolant to a compressor, operating the compressor to produce a flow of compressed fluid having a discharge temperature, and separating the flow of coolant from the flow of compressed fluid. The method further includes collecting the flow of coolant in a reservoir, directing a portion of the collected coolant to a cooler, and discharging a flow of cooled coolant from the cooler. The method further includes positioning a valve to receive the flow of cooled coolant and a second portion of the collected coolant, and moving the valve in response to the discharge temperature to vary at least one of the flow of cooled coolant and the flow of the second portion.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
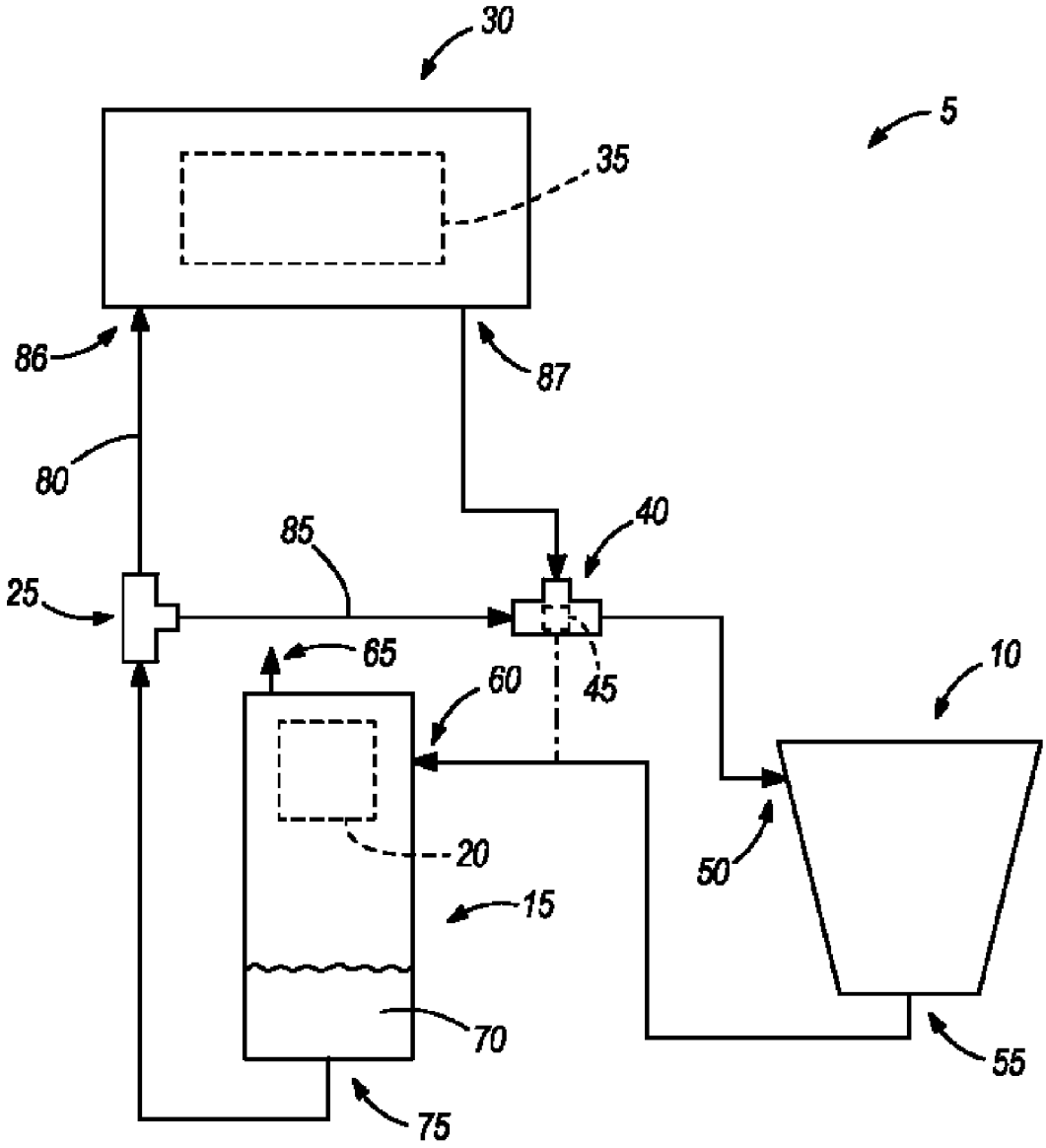
FIG. 1 is a schematic view of a compressor system including a control valve embodying the invention.

FIG. 1 shows a fluid compression system 5 that includes a compressor 10, a coolant source 15, a separator 20, a flow divider 25, a coolant cooler 30, a heat exchanger 35, a valve 40 and a sensor 45. The compressor 10 receives a flow of fluid at or near atmospheric pressure at a compressor inlet 50 and discharges a compressed flow of fluid at a compressor outlet 55. In one embodiment, the compressor 10 is a rotary-screw air compressor. In other constructions, other varieties of compressors 10 are employed, such as centrifugal, reciprocating, rotary, etc. In addition, while a single stage compressor is illustrated, other constructions may employ multi-stage compressors, as desired.

In some embodiments, air is compressed, while in other embodiments, other gasses, liquids, or combinations thereof are compressed in the compressor 10. The description herein describes the working or compressed fluid as air. However, other fluids could be employed if desired. The compressor 10 is preferably a variable-speed compressor that operates between a first high speed and a second slow speed. The compressor 10 can also operate at any speed within a range of speeds between the first high speed and the second slow speed. In some embodiments, the compressor speed is incremental, so that it can be increased to a set number of intermediate speeds within the range of speeds. In other embodiments, the compressor speed is non-incremental, so that the speed can be any speed within the range of speeds.

During the compression process, the compressor 10 generates heat through performing mechanical work. Heat is removed from the compressor 10 by routing a coolant, such as oil, through the compressor 10 to absorb the heat. In addition to providing cooling, the coolant also serves as a lubricant between moving parts and enhances the seal between those moving parts. While the coolant is often referred to as "oil" herein, petroleum as well as non-petroleum based coolants may also be employed.

The coolant source 15 includes the separator 20 or lubricant separator and receives a mixed flow of coolant and air at a coolant source inlet 60. The separator 20 operates to separate the air from the coolant. In a preferred construction, a cyclonic separator is employed with other types of separators also being possible. The compressed air is discharged at an air outlet 65 and directed toward a desired application, such as air tools, pneumatic equipment, etc. The coolant source 15 is sized to hold a quantity of coolant 70 and discharge the coolant at a coolant source outlet 75.

The flow divider 25 directs the coolant along either a first coolant path 80 or a second coolant path 85. The first coolant path 80 extends from the coolant source 15 through the coolant cooler 30. The second coolant path 85 extends from the coolant source 15, bypasses the cooler 30 and is then directed into the valve 40.

The coolant cooler 30 includes the heat exchanger 35, which is of the type suitable for removing heat from a fluid (e.g., finned tube, plate-fin, shell and tube, etc.). The coolant cooler 30 receives a flow of coolant at a cooler inlet 86 and discharges a flow of cooled coolant at a cooler outlet 87. The coolant is then directed to the valve 40.

The valve 40 is configured to selectively restrict the flow along the second coolant path 85. The valve 40 may be any valve suitable to restrict flow through a passage, such as a ball valve, a butterfly valve, a gate valve, a globe valve, etc. The valve 40 moves between being completely open and completely closed. The valve 40 may be positioned at a completely open position, a completely closed position or at any intermediate position therebetween. In one embodiment, the valve 40 is manual, such that an operator can move an actuator to position the valve 40. In another embodiment, the valve 40 is automatic, such that it moves in response to the measured temperature of the sensor 45.

The sensor 45 is positioned to measure the temperature of the combination of coolant and compressed air that is discharged from the compressor outlet 55. The sensor 45 is in communication with the valve 40, so that the valve 40 opens or closes in response to the measured temperature. In some embodiments, the sensor 45 is a mechanical sensor (e.g. a bi-metallic sensor or a thermostatic wax sensor), while in other embodiments, the sensor 45 is an electrical sensor (e.g. thermocouple, thermistor). In some constructions, the sensor 45 and valve 40 are combined into one component that senses the temperature and responds to that temperature to control the amount of coolant that is directed along the second flow path 85.

One embodiment of combined sensor 45 and valve 40 or controller includes a thermostatic wax element that expands and contracts in response to changes in temperature. When the temperature increases, the wax element expands to move a diaphragm or piston to limit or cut off the flow of coolant through the second flow path 85. When the temperature decreases, the wax element contracts to move the diaphragm or piston to increase the opening and allow a large quantity of coolant to flow through the second flow path 85. The valve 40 of FIG. 1 is combined with the sensor 45 and is embodied as a two-way thermostatic control valve.

Figure 2:
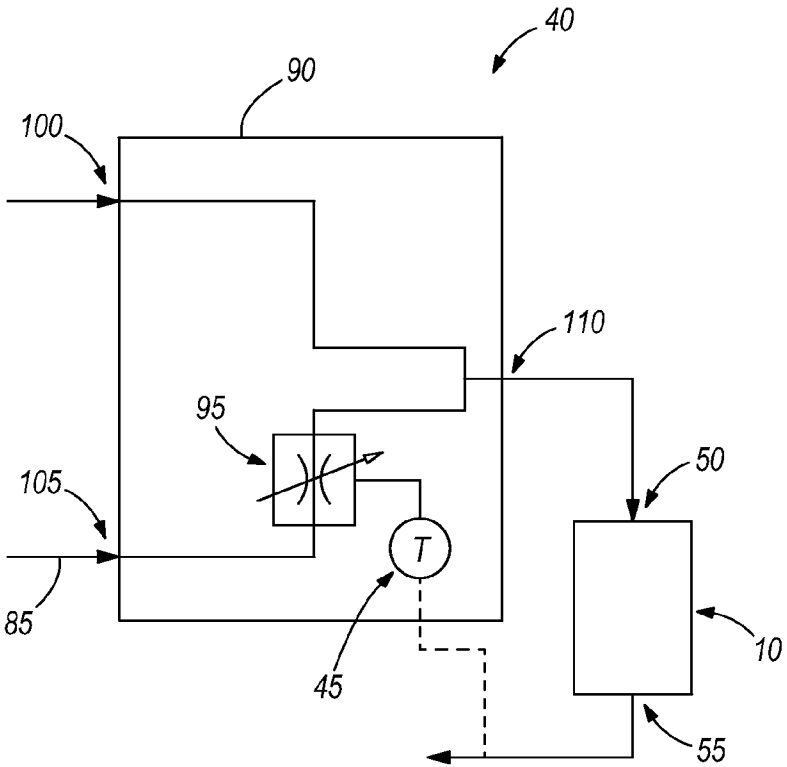
FIG. 2 is a schematic view of the control valve of FIG. 1.

FIG. 2 schematically illustrates the two-way thermostatic control valve 40 of FIG. 1 in more detail. The illustrated valve 40 includes a valve housing 90, a variable opening or orifice 95, and the temperature sensor 45. The valve 40 receives a flow of coolant from the cooler 30 in a first valve inlet 100 and a flow of coolant from the second path 85 through a second valve inlet 105. The flow through the first and second inlets 100, 105 is combined to produce one flow that exits the valve out of a valve outlet 110. The opening of the variable opening 95 and the temperature sensor 45 are operably coupled so that the temperature sensor controls the variable opening 95. The variable opening 95 limits the flow of coolant through the second inlet 105 in response to the temperature sensor 45. The temperature sensor 45 is positioned to measure the compressor discharge temperature of the air and coolant mixture that is discharged from the compressor outlet 55. The compressor discharge temperature varies in response to the varying speed of operation of the compressor 10, as well as other factors. The sensor 45 measures this temperature and directly controls the second flow in response to the measured temperature.

In the embodiment shown in FIG. 2, the flow through the first valve inlet 100 is not directly controlled by the valve 40. The only restriction on the first valve inlet 100 flow is the size of the valve outlet 110. For example, if the variable opening 95 is in a completely open position, the amount of coolant drawn from the first valve inlet 100 through the outlet 110 may decrease, because a maximum amount of coolant would be allowed to flow from the second valve inlet 105 through the outlet 110. Thus, the total coolant output by the valve remains substantially constant and the variable opening 95 varies the percentage of flow through the second valve inlet 105 in the total output at the outlet 110.

Figure 3:
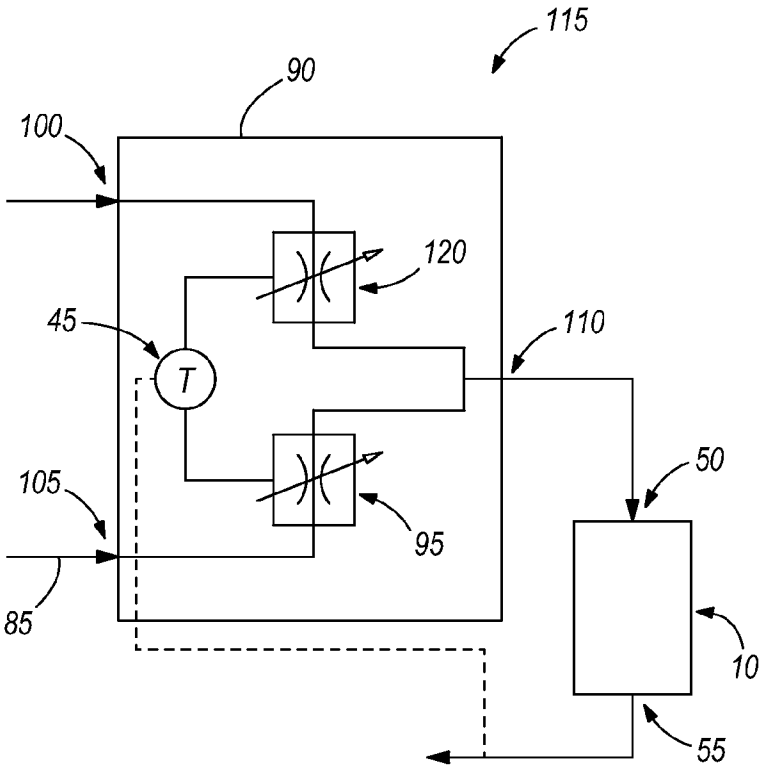
FIG. 3 is a schematic view of another control valve suitable for use in the compressor system of FIG. 1.

In other constructions, a three-way valve 115, shown schematically in FIG. 3 is employed rather than the two-way valve 40 of FIG. 2. The embodiment shown in FIG. 3 is similar to the embodiment shown in FIG. 2. However, the three-way valve 115 includes a first variable opening 120 positioned between the first valve inlet 100 and the valve outlet 110, in addition to a second variable opening 95 positioned between the second valve inlet 105 and the valve outlet 110. The first and second variable openings 120, 95 change how much flow is able to pass from the first and second valve inlets 100, 105, respectively, prior to flowing out of the valve outlet 110. In the illustrated embodiment, the first and second variable openings 120, 95 respond to the temperature sensed by the sensor 45. However, in other embodiments, the first and second variable openings 120, 95 are provided with respective first and second temperature sensors. When the temperature is too high, the first variable opening 120 increases the size of the aperture 120 to allow additional cooled coolant flow from the first valve inlet 100, whereas, the second variable opening 95 reduces the size of the aperture 95 to inhibit the flow of coolant from the second valve inlet 105. In contrast, when the temperature is too low, the first variable opening 120 inhibits the flow of cooled coolant from the first valve inlet 100, while the second variable opening 95 increases the flow of coolant through the aperture 95 to increase the flow from the second valve inlet 105.

With reference to FIG. 1, in operation, the compressor 10 draws in air that is at or near atmospheric pressure and coolant 70 that is at the first, low temperature. The compressor 10 discharges the compressed air and discharges the coolant 70 at the second, high temperature. The compressor discharge temperature is measured by the temperature sensor 45. The compressed air and discharged coolant 70 are then directed into the coolant source 15 where the compressed air is separated from the discharged coolant 70. The compressed air is directed toward a desired application, such as molding equipment, air tools, pneumatic controllers, etc. The discharged coolant 70 is collected and held in the coolant source 15. The coolant 70 is drawn from the coolant source 15 and directed into either the first path 80 or the second path 85. The first path 80 passes through the coolant cooler 30 to remove some of the heat from the coolant 70 before the coolant 70 is directed to the valve. The second path 85 bypasses the coolant cooler 30 and flows directly to the valve 40, 115. Thus, the coolant that passes to the compressor inlet 50 has a temperature between the temperature of the cooled coolant and the bypass coolant.

In the embodiment illustrated in FIG. 2, the valve 40 includes one variable opening 95 positioned to selectively restrict flow of the coolant through the second valve inlet 105, whereas flow of the coolant through the first valve inlet 100 is substantially unrestricted. The variable opening 95 varies the flow of the coolant from the second path 85 in response to the measured temperature of the combined compressed air and coolant that are discharged from the compressor 10. When the measured compressor discharge temperature increases, the variable opening 95 further inhibits coolant from flowing from the second valve inlet 105 through the valve 40. Therefore, a greater percentage of the outlet flow is cooled in the coolant cooler, thereby reducing the outlet flow temperature. The flow through the outlet 110 is directed into the compressor inlet 50.

Conversely, when the compressor discharge temperature decreases, the variable opening 95 opens to allow an increase of the flow from the second flow path 85 through the valve 40. Therefore, a greater percentage of un-cooled or bypass coolant is allowed to flow through the valve outlet 110, thereby increasing the temperature of the coolant 70. The flow through the valve outlet 110 is directed into the compressor inlet 50. In this way, the valve of FIG. 2 controls the compressor outlet temperature while maintaining a substantially constant flow to the compressor 50.

In the embodiment illustrated in FIG. 3, the valve 115 includes the first variable opening 120 on the flow of coolant from the first valve inlet 100 and the second variable opening 95 on the flow of coolant from the second valve inlet 105. The variable openings 120, 95 each individually, selectively change from greatly inhibiting, partially inhibiting or minimally inhibiting the flow of the coolant 70 through the valve 115. The first and second variable openings 120, 95 respond in opposite ways to provide a faster response to changes in temperature of the air and coolant mixture that is discharged from the compressor 10. For example, as the mixture temperature decreases, the first variable opening 120 further inhibits the flow from the first valve inlet 100, whereas the second variable opening 95 reduces the inhibition for the flow from the second valve inlet 105. Conversely, as the mixture temperature increases, the first variable opening 120 reduces the inhibition for the flow from the first valve inlet 100, whereas the second variable opening 95 further inhibits the flow from the second valve inlet 105. The total flow discharged from the three-way valve 115 remains substantially constant even though the three-way valve 115 allows for variation of both the flow of coolant from the first valve inlet 100 and the flow of coolant from the second valve inlet 105.

The three-way valve 115 allows for the control and reduction of either the first flow of coolant from the first valve inlet 100 or the second flow of coolant from the second valve inlet 105 to zero. The two-way valve 40 allows for the control and reduction to zero of only one of the two flows. The remaining flow is essentially uncontrolled. Thus, the three-way valve 115 is able to react faster and is able to reach temperature extremes that are not reached by the two-way valve 40.

Various features and advantages of the invention are set forth in the following claims.

What is claimed is:

1. A compressor configured to discharge a flow of compressed fluid, the compressor comprising:

a sensor positioned to measure a first temperature indicative of the temperature of the flow of compressed fluid;

a coolant source;

a cooler positioned to receive a first flow of coolant from the coolant source and discharge a flow of cooled coolant; and a valve positioned to receive the flow of cooled coolant and a second flow of coolant from the coolant source and to discharge a third flow of coolant having a coolant temperature, the valve movable between a first position and a second position to vary the coolant temperature in response to the first temperature.

2. The compressor of claim 1, wherein the sensor is positioned proximate an outlet of the compressor such that the first temperature is a compressor discharge temperature.

3. The compressor of claim 1, wherein the flow of compressed fluid includes a mixture of coolant and compressed gas.

4. The compressor of claim 1, wherein the valve is configured to actively vary the second flow of coolant, the flow of cooled coolant varying in response to the change in flow rate of the second flow of coolant, such that the third flow of coolant has a substantially constant flow rate no matter the position of the valve.

5. The compressor of claim 1, wherein the valve is configured to actively vary the second flow of coolant and the flow of cooled coolant, such that the third flow of coolant has a substantially constant flow rate no matter the position of the valve.

6. The compressor of claim 1, wherein the valve is configured to actively vary both the flow of cooled coolant and the second flow of coolant such that the third flow of coolant also varies.

7. The compressor of claim 1, wherein the sensor is a mechanical sensor.

8. The compressor of claim 7, wherein the mechanical sensor includes a wax element that expands in response to an increase in temperature to vary at least one of the flow of cooled coolant and the second flow of coolant through the valve.

9. The compressor of claim 1, wherein the coolant source includes a lubricant separator.

10. A compressor system comprising:

a compressor configured to receive a flow of coolant and a flow of fluid and to discharge a flow of compressed fluid at a temperature;

a source positioned to receive the flow of compressed fluid and to separate the flow of compressed fluid into a coolant and a compressed gas;

a cooler positioned to receive a first flow of coolant from the source and discharge a cooled coolant;

a bypass passage positioned to receive a second flow of coolant from the source;

a sensor configured to measure a discharge temperature of the flow of compressed fluid; and a control valve moveable in response to the measured discharge temperature to vary a flow rate of the cooled coolant and a flow rate of the second flow of coolant from the source and to direct a flow of coolant to the compressor.

11. The compressor system of claim 10, wherein the control valve is configured to directly vary the flow rate of the second flow of coolant between zero and one hundred percent, and to indirectly vary the flow rat of the cooled coolant, such that the flow of coolant to the compressor remains substantially constant.

12. The compressor system of claim 10, wherein the control valve is configured to directly vary the second flow of coolant between zero and one hundred percent, and to indirectly vary the flow of cooled coolant, such that the flow of coolant to the compressor remains substantially constant.

13. The compressor of claim 10, wherein the sensor includes a wax element that expands in response to an increase in temperature to vary at least one of the flow rate of cooled coolant and the flow rate of the second flow of coolant through the valve.

14. The compressor of claim 10, wherein the control valve is moveable to a first position that inhibits the second flow from flowing through the output, a second position that allows the second flow to flow through the output at a maximum rate, and a third position that allows the second flow to flow through the output at an intermediate rate.

15. The compressor of claim 10, wherein the control valve is moveable to directly vary the flow rate of the cooled coolant and the flow rate of the second flow to output a variable flow.

16. A method of compressing a fluid, the method comprising:

directing a flow of coolant to a compressor;

operating the compressor to produce a flow of compressed fluid having a discharge temperature;

separating the flow of coolant from the flow of compressed fluid;

collecting the flow of coolant in a reservoir;

directing a portion of the collected coolant to a cooler;

discharging a flow of cooled coolant from the cooler;

positioning a valve to receive the flow of cooled coolant and a second portion of the collected coolant;

moving the valve in response to the discharge temperature to vary at least one of the flow of cooled coolant and the flow of the second portion.

17. The method of claim 16, further comprising varying a ratio of the flow of the second portion of the coolant and the flow of cooled coolant directed through the valve to produce the flow of coolant.

18. The method of claim 16, further comprising varying the quantity of coolant that is directed to the compressor.

19. The method of claim 16, further comprising moving the valve between a first position and a second position to vary the flow of the second portion between a minimum rate and a maximum rate.

20. The method of claim 16, further comprising varying both the flow of cooled coolant and the flow of the second portion of the collected coolant.

* * * * *